US010589888B2

(12) United States Patent
Kawada

(10) Patent No.: US 10,589,888 B2
(45) Date of Patent: Mar. 17, 2020

(54) TAG MOUNTER

(71) Applicant: TOWA SEIKO CO., LTD., Tokyo (JP)

(72) Inventor: Toshikazu Kawada, Tokyo (JP)

(73) Assignee: TOWA SEIKO CO., LTD., Tokyo (JP)

( * ) Notice: Subject to any disclaimer, the term of this patent is extended or adjusted under 35 U.S.C. 154(b) by 406 days.

(21) Appl. No.: 15/499,019

(22) Filed: Apr. 27, 2017

(65) Prior Publication Data

US 2017/0313460 A1 Nov. 2, 2017

(30) Foreign Application Priority Data

May 2, 2016 (JP) ..... 2016-092406

(51) Int. Cl.
*B65C 7/00* (2006.01)
*B31D 1/02* (2006.01)

(52) U.S. Cl.
CPC ..... *B65C 7/00* (2013.01); *B31D 1/023* (2013.01); *B31D 2201/02* (2013.01)

(58) Field of Classification Search
CPC ..... B65C 7/00; B65C 7/001; B65B 29/04
See application file for complete search history.

(56) References Cited

U.S. PATENT DOCUMENTS 4,558,894 A * 12/1985 Detterbeck ..... H01B 13/01272 140/93 R
2003/0029900 A1* 2/2003 Ueno ..... B65C 7/00 227/58
2008/0237292 A1 10/2008 Lee

FOREIGN PATENT DOCUMENTS

JP 03-43137 7/1991
KR 10-2013-0139516 12/2013

OTHER PUBLICATIONS

Extended European Search Report dated Sep. 28, 2017 in corresponding European Application No. 17168683.5.

* cited by examiner

*Primary Examiner* — Shaun R Hurley
(74) *Attorney, Agent, or Firm* — Wenderoth, Lind & Ponack, L.L.P.

(57) ABSTRACT

A tag mounter (21) is provided for mounting a tag to an object by passing and tying a thread (23) through the object. A pipe unit (25) is configured to insert the thread (23) through it. A movement mechanism (29) is configured to move the pipe unit (25) toward a front direction and a rear direction. A gripper unit (27) is configured to grip the thread (23) inserted through the pipe unit (25) and exposed from a tip of the pipe unit (25). A driver unit (6) is configured to move the gripper unit (27) along a predetermined course. A thread tying mechanism (16) is configured to tie the thread (23) gripped by the gripper unit (27).

12 Claims, 10 Drawing Sheets

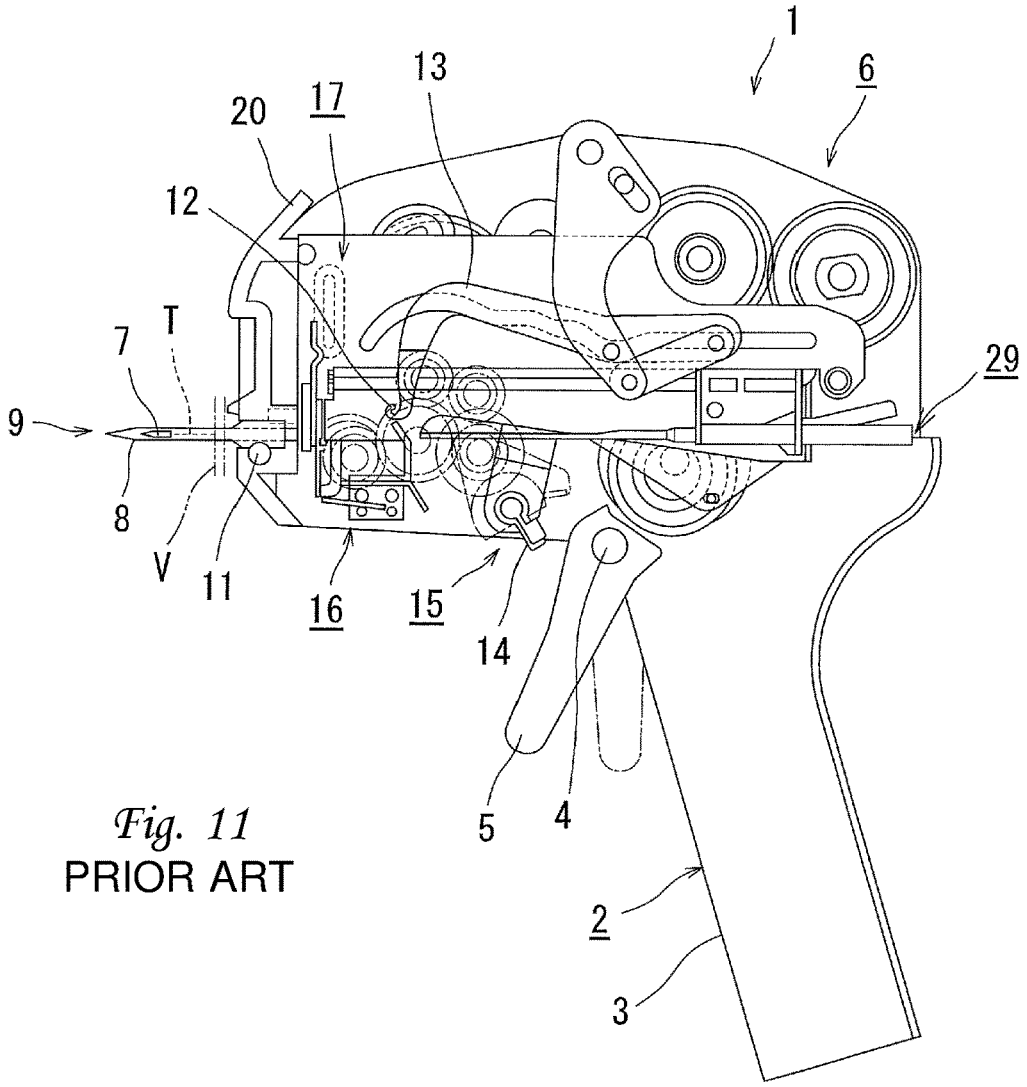
*Fig. 11*
PRIOR ART
*Fig. 12*
PRIOR ART
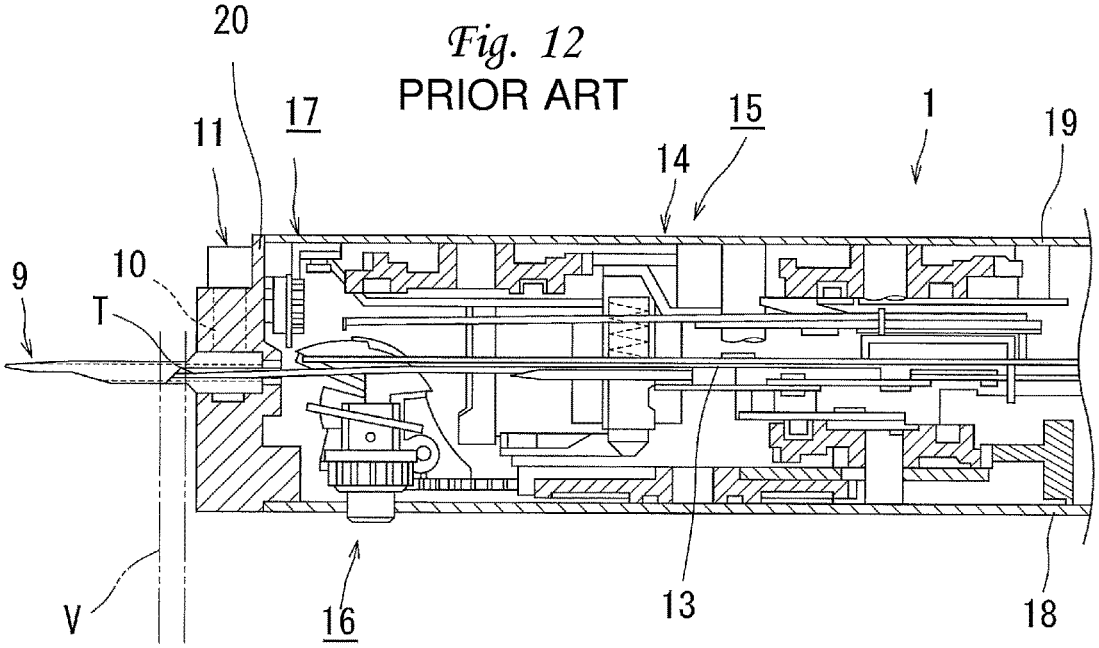

TAG MOUNTER

CROSS-REFERENCE TO RELATED APPLICATIONS

This application claims the benefit of and priority to Japanese Patent Application No. 2016-092406 filed on May 2, 2016, which is incorporated herein by reference in its entirety.

BACKGROUND OF THE INVENTION

1. Field of the Invention

The present invention relates to a tag mounter.

2. Description of the Related Art

A tag mounter is for threading an object such as a product to mount a price tag or other tags on it.

A conventional tag mounter is known as described in Japanese Examined Patent Publication No. H3-43137, filed by the Applicant of the present application, which is incorporated herein by reference in its entirety.

FIGS. 11 and 12 illustrate the tag mounter 1 including a machine frame 2, a driving lever 5, and a driver unit 6. The machine frame 2 has a handle 3 protruding from it. The driving lever 5 is mounted on a base portion of the handle 3, and has capability to pivot around a lever shaft 4. Two grasping operations of the driving lever 5 makes the driver unit 6 to perform actions, which will be described below in details. A part of the machine frame 2 and some mechanisms are omitted in FIG. 11 for explanation.

The tag mounter 1 also includes a cylindrical needle 9, a piercing needle 8, a thread grasping mechanism 15, a hooking member 13, and a thread tying mechanism 16. The cylindrical needle 9 is mounted on a front face of the machine frame 2. Piercing the cylindrical needle 9 through an object V makes a hole for passing a thread T through the object V. The piercing needle 8 has a needle eye 7 at its tip. The needle eye 7 is for inserting the thread T through it. The thread grasping mechanism 15 has a thread grasping unit 14. The thread grasping unit 14 is configured to grasp a tip of the thread T inserted through the needle eye 7. The piercing needle 8 is reciprocated toward a front direction and a rear direction by the driver unit 6. When moving forward, the piercing needle 8 goes in the cylindrical needle 9, penetrates the hole made through the object V, and exposes its tip from the cylindrical needle 9. The thread T inserted through the needle eye 7 then extends sideward from the tip of the piercing needle 8 and forms a loop shape. The hooking member 13 has a threading hook 12 at its tip. Movement of the hooking member 13 caused by the driver unit 6 makes the threading hook 12 to hook the loop of the thread T extending from the piercing needle 8, to lift the hooked thread T upward, then to retract it backward. The thread tying mechanism 16 is configured to tie an end portion of the thread T grasped by the thread grasping mechanism 15 and a midway portion of the thread T retracted by the hooking member 13 to form a loop, and then to cut off the tied loop from the thread T.

SUMMARY OF THE INVENTION

Insertion of the thread through the needle eye in the conventional tag mounter prohibits using a thicker thread than the needle eye. Even using a thread thinner than the needle eye, the tag mounter may not smoothly work when the thread is relatively thick and/or has large friction resistance, caused by large friction with the needle eye. Conversely, when the thread is relatively thin and/or has small strength, the friction with the needle eye may cause breaking the thread. This results in restriction of thicknesses and/or types of available threads. For example, a gold thread or a silver thread can not be used.

The present invention aims to solve these problems, to ease restriction of thicknesses and/or types of available threads, and thereby to enable to use various threads including a gold thread and a silver thread.

A tag mounter according to the present invention is for mounting a tag to an object by passing and tying a thread through the object. The tag mounter may include a pipe unit. The pipe unit may be configured to insert the thread through it. The tag mounter may include a movement mechanism. The movement mechanism may be configured to move the pipe unit toward a front direction and a rear direction. The tag mounter may include a gripper unit. The gripper unit may be configured to grip the thread inserted through the pipe unit and exposed from a tip of the pipe unit. The tag mounter may include driver mechanism. The driver mechanism may be configured to move the gripper unit along a predetermined course. The tag mounter may include thread tying mechanism. The thread tying mechanism may be configured to tie the thread gripped by the gripper unit.

The gripper unit may be configured to grip a tip of the pipe unit when the movement mechanism moves the pipe unit toward the front direction. The movement mechanism may be configured to move the pipe unit toward the rear direction with the gripper unit gripping the tip of the pipe unit, so that the pipe unit escapes from the gripper unit and the gripper unit grips the thread exposed from the tip of the pipe unit.

The gripper unit may have a pair of gripper pieces. The pair of gripper pieces may be configured to have capability of opening and closing, and to be biased toward a closing direction. The thread may be gripped between the gripper pieces. The pair of gripper pieces may be arranged to close in a front side. The movement of the gripper unit caused by the driver mechanism may make the pipe unit to abut the pair of gripper pieces and to force the pair of gripper pieces to open.

The forward movement of the pipe unit caused by the movement mechanism may make the pipe unit to penetrate the object. The backward movement of the pipe unit caused by the movement mechanism may make the pipe unit to escape from the object so that the thread gripped by the gripper unit remains alone penetrating the object.

The driver mechanism may be configured to move the gripper unit to a far side of the object by taking a detour above the object, to grip the tip of the pipe unit penetrating the object and exposed from a back face of the object. The driver mechanism may be configured to move the gripper unit to a near side of the object by taking a detour above the object, after the pipe unit moves toward the rear direction and the gripper unit grips the thread. The thread tying mechanism may be located at the near side of the object, and configured to tie the thread gripped by the gripper unit and the thread before the object.

The tag mounter may include a thread hanging unit disposed above the pipe unit. The thread gripped by the gripper unit may be hung on the thread hanging unit to form a loop, when the gripper unit moves to the near side of the object by taking a detour above the object.

In the tag mounter according to the present invention, gripping and retracting the tip of the thread exposed from the tip of the pipe unit by the gripper unit may enable to eliminate insertion of the thread through a needle eye. This may enable to ease restriction of thicknesses and/or types of threads, which is caused by a size of the needle eye and/or a friction with the needle eye. This may enable to use various threads including a gold thread or a silver thread.

Gripping the tip of the pipe unit by the gripper unit, and removal of the pipe unit from the gripper unit may enable the gripper unit to grip the thread exposed from the tip of the pipe unit. This may enable to ensure to grip the thread with a simple structure.

BRIEF DESCRIPTION OF THE DRAWINGS

Preferable embodiments of the present invention will be described in detail herein below with reference to the attached drawings, which is intended to facilitate understanding the present invention, but not to limit the scope of the present invention in any meanings.

FIGS. 11 and 12 are a side view and a partially expanded sectional plan view of an internal structure of a conventional tag mounter.

DESCRIPTION OF THE PREFERRED EMBODIMENTS

Figure 1:
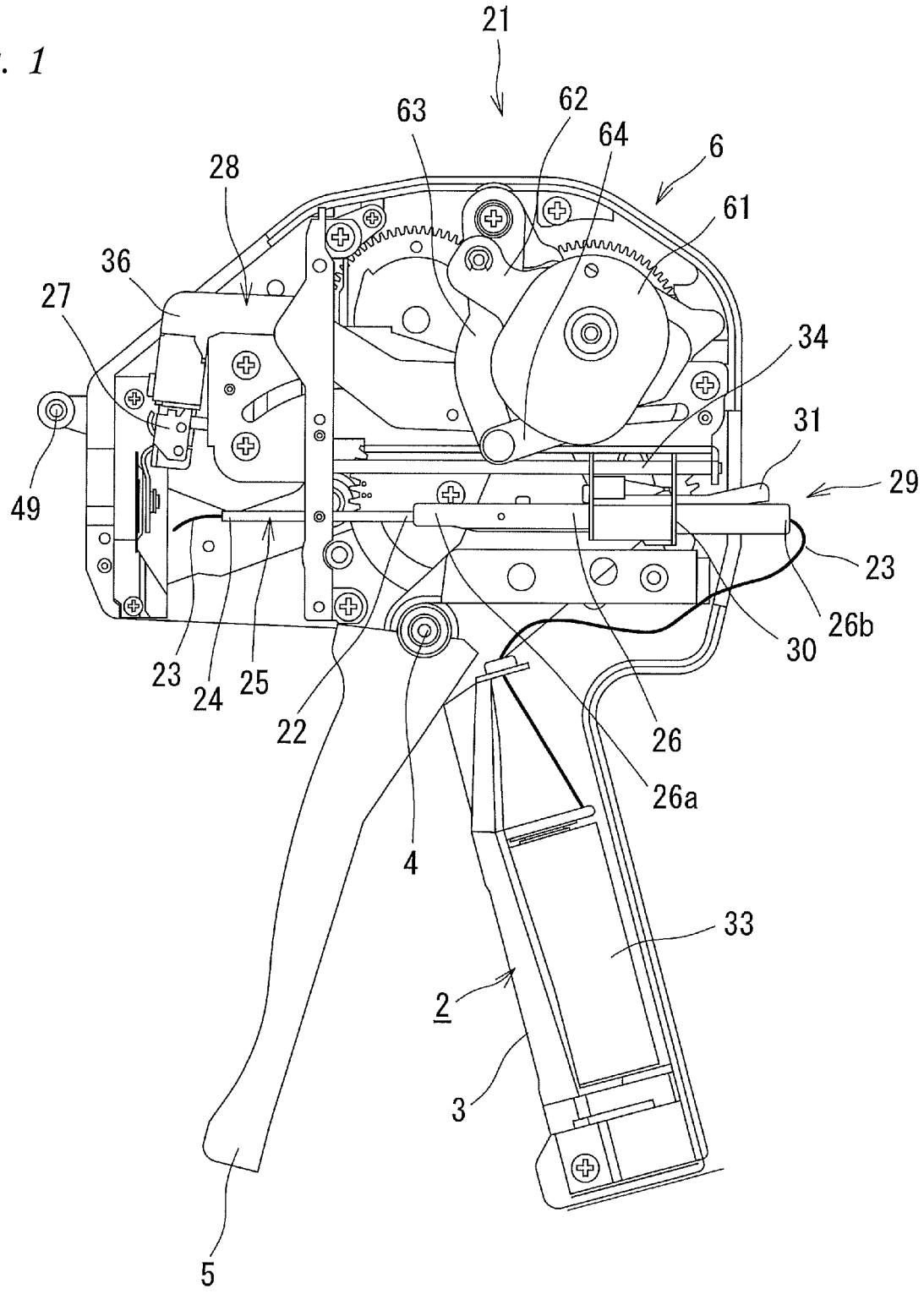
FIGS. 1 to 8 are side views showing an example of an internal structure of a tag mounter.

FIG. 1 shows a tag mounter 1 including a machine frame 2, a driving lever 5, and a driver unit 6. The machine frame 2 has a handle 3 protruding from it. The driving lever 5 is mounted on a base portion of the handle 3, and has capability to pivot around a lever shaft 4. Two grasping operations of the driving lever 5 makes the driver unit 6 to perform actions, which will be described below in details. A part of the machine frame 2 and some mechanisms are omitted in FIGS. 1 to 8 for explanation.

The handle 3 accommodates a bobbin 33. The bobbin 33 has a thread 23 coiled around it. The bobbin 33 has capability to rotate in the handle 3. This enables to pay out the coiled thread 23.

The machine frame 2 has a thread hanging unit 49 at its front face. The thread hanging unit 49 is for making uniformity of a size of a loop of the thread 23 formed by the tag mounter 21. The thread hanging unit 49 is a shaft substantially parallel to a left/right direction, and fixed to the machine frame 2 with only one side.

The tag mounter 21 includes a pipe unit 25. The pipe unit 25, made of metal for example, has a tubular shape with a penetration hole, and is disposed extending along a front/rear direction. The penetration hole communicates a front side opening 24 and a rear side opening 22. The penetration hole is for inserting the thread 23 through it. The pipe unit 25 is configured to guide the thread 23 inserted through the penetration hole.

The tag mounter 21 includes a pipe holding unit 26. The pipe holding unit 26 has a tubular shape with a penetration hole, and is disposed extending along the front/rear direction. The penetration hole communicates a front side opening 26*a* and a rear side opening 26*b*. The pipe unit 25 is held by inserting and fitting its rear end into the penetration hole of the pipe holding unit 26 from the front side opening 26*a*. This makes communication of the penetration hole of the pipe unit 25 and the penetration hole of the pipe holding unit 26, to form a long single penetration hole. The pipe holding unit 26 has a release lever 31 on its upper side.

The tag mounter 21 includes a movement mechanism 29. The movement mechanism 29 has a frame unit 30, and a frame guiding shaft 34. The frame unit 30 is for mounting the pipe holding unit 26 on it. The release lever 31 is for removal of the pipe holding unit 26 from the frame unit 30. The frame guiding shaft 34 extends along the front/rear direction. The frame unit 30 has capability of forward/backward movement along the frame guiding shaft 34.

A user can push down the release lever 31 to remove the pipe holding unit 26 from the frame unit 30, along with the pipe unit 25 held by it. Next, the user can draw the thread 23 out from the bobbin 33, and insert a tip of the drawn thread 23 into the rear side opening 26*b* of the pipe holding unit 26. The tip of the thread 23 inserted into the rear side opening 26*b* passes through the penetration hole of the pipe holding unit 26, enters into the pipe unit 25 from the rear side opening 22 of the pipe unit 25, passes through the penetration hole of the pipe unit 25, and is finally exposed from the front side opening 24 of the pipe unit 25. While keeping this state, the user can mount the pipe holding unit 26 on the frame unit 30, along with the pipe unit 25 held by it.

The driver unit 6 is configured to create forward/backward reciprocation of the frame unit 30 along the frame guiding shaft 34. This causes forward/backward movement of the pipe holding unit 26 mounted on the frame unit 30 and the pipe unit 25 held by the pipe holding unit 26, integrated with the frame unit 30.

The tag mounter 21 includes a gripper unit 27. The gripper unit 27 is configured to grip the thread 23 exposed from the front side opening 24 of the pipe unit 25.

The tag mounter 21 includes a gripper supporting unit 28. The gripper unit 27 is disposed at a tip of the gripper supporting unit 28.

The driver unit 6, or a driver mechanism, is configured to create reciprocation of the gripper supporting unit 28. This causes movement of the gripper unit 27 along a predetermined course, which in turn makes upward lifting and following backward retraction of the gripped thread 23.

The tag mounter 21 includes a thread tying mechanism 16. The thread tying mechanism 16 is configured to tie an end portion of the thread 23 retracted by the gripper unit 27 and a midway portion of the thread 23 exposed from the pipe unit 25, to form a loop. The thread tying mechanism 16 is also configured to cut off the tied loop from the thread 23 inserted through the pipe unit 25.

The driver unit 6 has, for example, a cam 61, a connector unit 62, a linkage unit 63, and a connector linkage unit 64. Operation of the driving lever 5 causes action of the driver unit 6, which includes making the pipe unit 25 to move toward the front/rear direction, and making the gripper unit 27 to move along the predetermined course, as described above.

Figure 9:
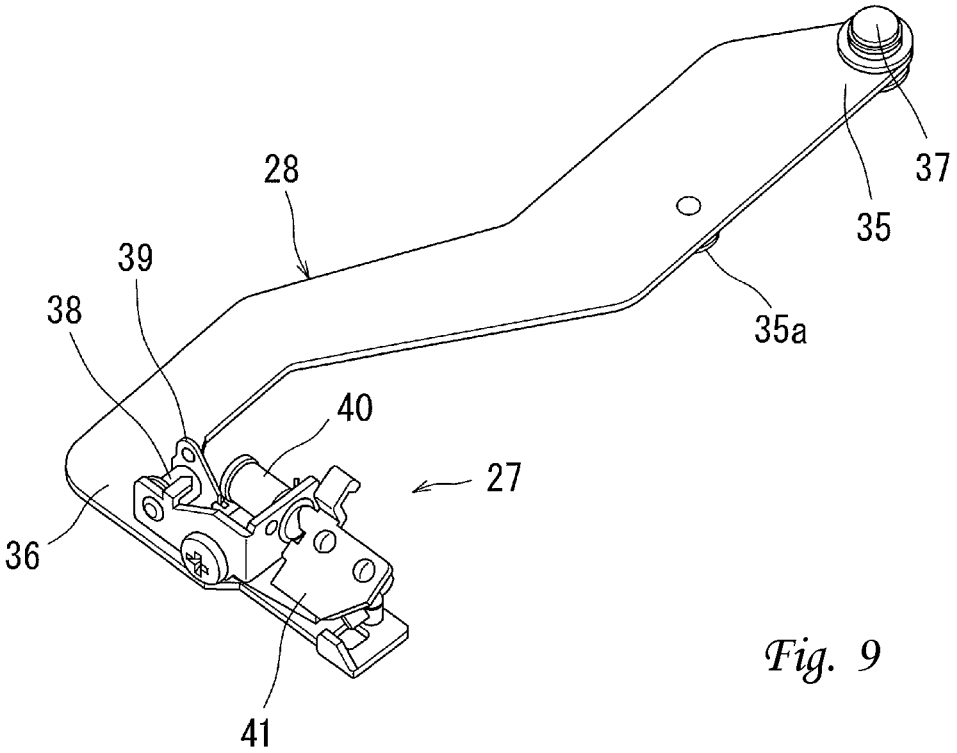
FIG. 9 is a perspective view showing an example of a gripper unit.

FIG. 9 illustrates the gripper supporting unit 28 having a base portion 35 and a winding portion 36. The winding portion 36 extends in a winding manner from the base portion 35, and have a front end where the gripper unit 27 is disposed. This is for making the gripper unit 27 to avoid the object and to reach a back side of the object.

The base portion 35 has a shaft section 37 at its rear end, and an engagement protrusion 35*a* at its middle. The shaft section 37 is connected with the connector linkage unit 64. The shaft section 37 and the engagement protrusion 35*a* are engaged with a guiding groove having a predetermined curving shape. The action of the driver unit 6 creates forward/backward movement and pivot movement of the gripper supporting unit 28, which in turn makes movement of the gripper unit 27 along the predetermined course.

The gripper unit 27 has a pair of gripper pieces 39 and 41. The gripper piece 39 has a plate shape extending along a upward/downward direction, and is pivotally fixed at its upper side to the gripper supporting unit 28. A pivot axis of the gripper piece 39 is roughly parallel to the front/rear direction. The gripper piece 41 has a plate shape, and is pivotally fixed at its rear side to the gripper supporting unit 28. A pivot axis of the gripper piece 41 is roughly parallel to the upward/downward direction. This gives capability of opening and closing to the pair of gripper pieces 39 and 41.

The gripper unit 27 has biasing members 38 and 40. The biasing member 38 is a torsion spring, for example, and configured to bias the gripper piece 39 toward a direction where a lower side of the gripper piece 39 approaches the gripper supporting unit 28. This makes a surface of the gripper piece 39 parallel to a front edge of the gripper piece 41. The biasing member 40 is a torsion spring, for example, and configured to bias the gripper piece 41 toward a direction where a front side of the gripper piece 41 approaches the gripper piece 39. This makes the pair of gripper pieces 39 and 41 are biased toward a closing direction, and causes the front edge of the gripper piece 41 in contact with the surface of the gripper piece 39. This enables the thread 23 to be gripped between the pair of gripper pieces 39 and 41.

A lower end portion of the gripper piece 39 is curved toward a direction where it approaches the gripper supporting unit 28. Also, a lower edge of the gripper piece 41 is obliquely cut off at its front side. This enables to push the pipe unit 25 between the pair of gripper pieces 39 and 41 from those lower sides, to force the pair of gripper pieces 39 and 41 to open.

Overcoming a biasing force by the biasing member 38 to lift up the gripper piece 39 makes the surface of the gripper piece 39 not parallel to the front edge of the gripper piece 41. This creates a gap between the surface of the gripper piece 39 and the front edge of the gripper piece 41. This enables to remove a broken thread remaining between the pair of gripper pieces 39 and 41 after cutting by the thread tying mechanism 16.

Figure 10:
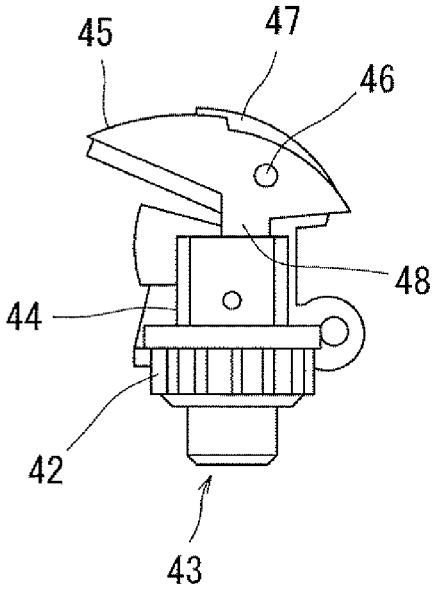
FIG. 10 is a plan view showing an example of a thread tying mechanism.

FIG. 10 illustrates the thread tying mechanism 16 having a pinion 42 and a knot forming unit 43. The pinion 42 is configured to drive rotation of the knot forming unit 43. The knot forming unit 43 has a rotary shaft 44 and a pair of beaks 45 and 47. The knot forming unit 43 is configured to rotate around the rotary shaft 44. The beak 45 has a neck section 48, and is fixed to a tip of the rotary shaft 44. The beak 47 has a shaft 46, is inserted between the beak 45, and pivotally attached by the shaft 46.

The thread tying mechanism 16 wraps the thread 23 around the neck section 48 by rotating by a certain angle with the pair of beaks 45 and 47 closed. Then, Opening the beak 47 and pulling the thread 23 makes a loop of the thread 23 wrapped around the neck section 48 to be released, and a tip of the thread 23 to pass through the loop. Thereby, a knot is formed. Finally, the thread 23 is cut between the pair of beaks 45 and 47.

The knot forming unit 43 is configured to rotate only when a second grasping operation of the driving lever 5, but not when a first grasping operation, so as to form the knot and to cut the thread.

Now, action is described below.

Before the driving lever 5 is grasped, the pipe unit 25 and the gripper unit 27 are both located in the rear direction, and accommodated in the machine frame 2, as shown in FIG. 1.

Figure 2:
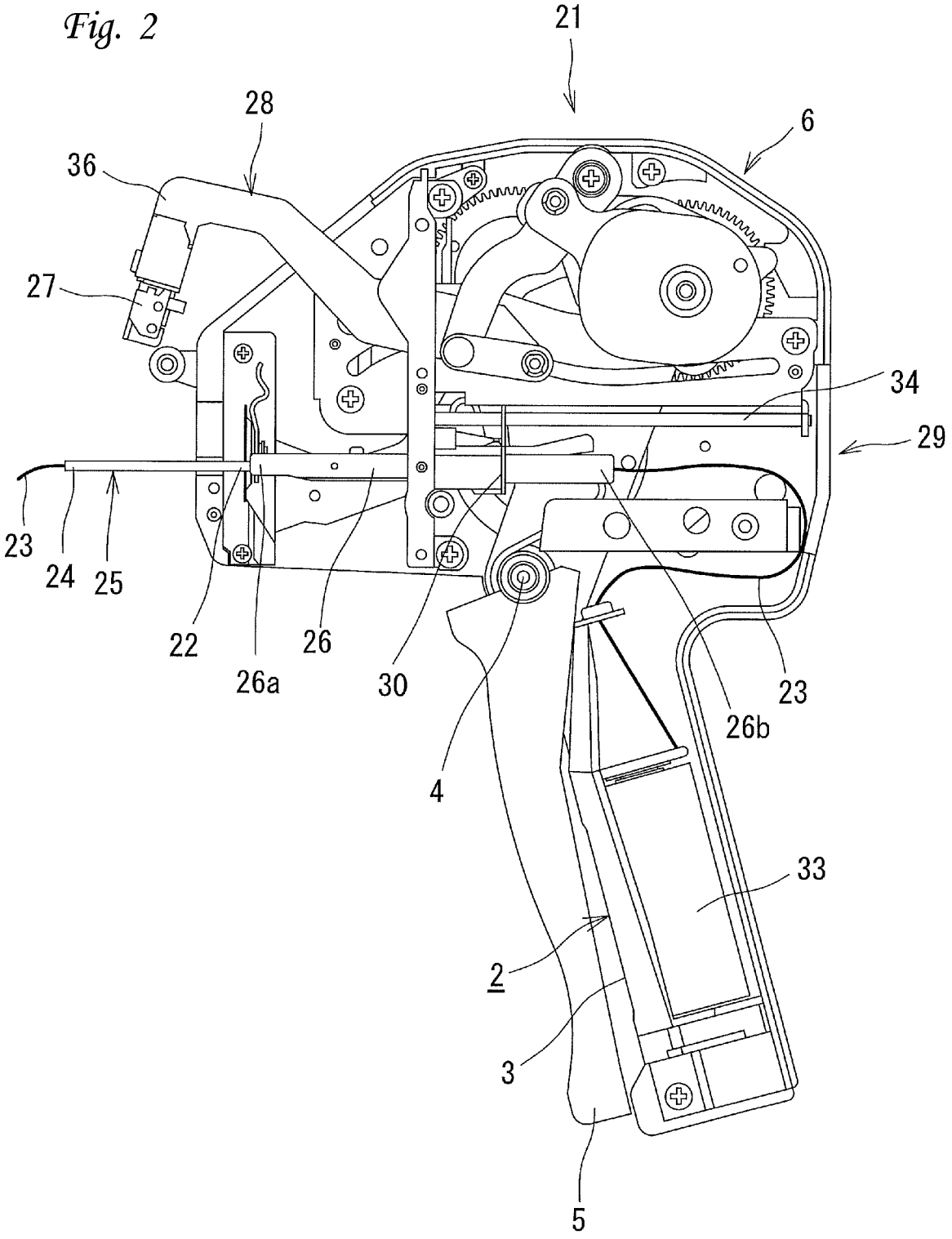

Grasping the driving lever 5 to pivot it makes advance of the pipe unit 25 to be exposed from the machine frame 2, as shown in FIG. 2, and to penetrate the object (not shown). The tip of the thread 23 inserted through the pipe unit 25 is exposed behind the object. The gripper unit 27 advances and rises, exposed from the machine frame 2, takes a detour above the object, and reaches the back side of the object.

Figure 3:
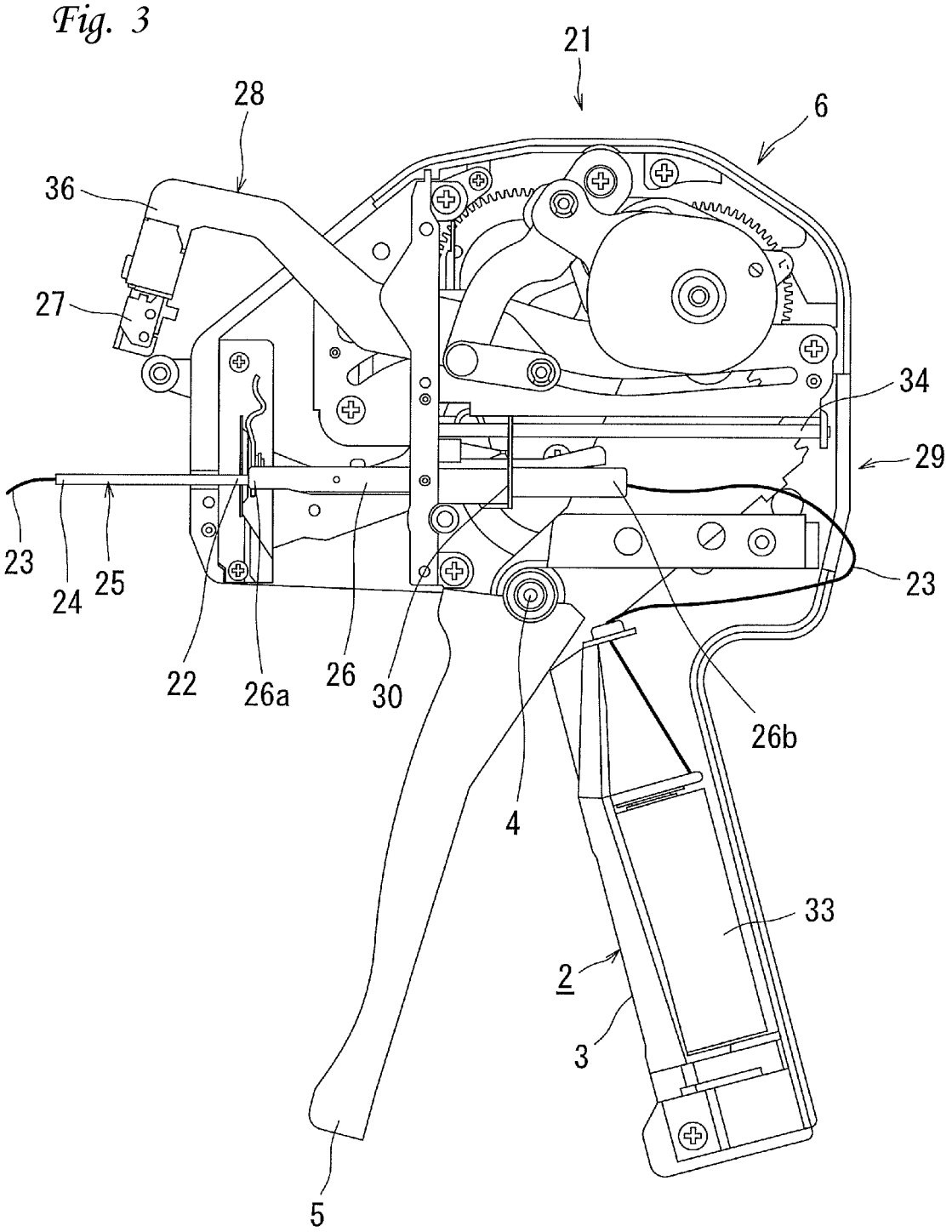

Then releasing the driving lever 5 makes the driving lever 5 to return to the original position, as shown in FIG. 3, but the pipe unit 25 and the gripper unit 27 does not move, and remains in the position shown in FIG. 2.

Figure 4:
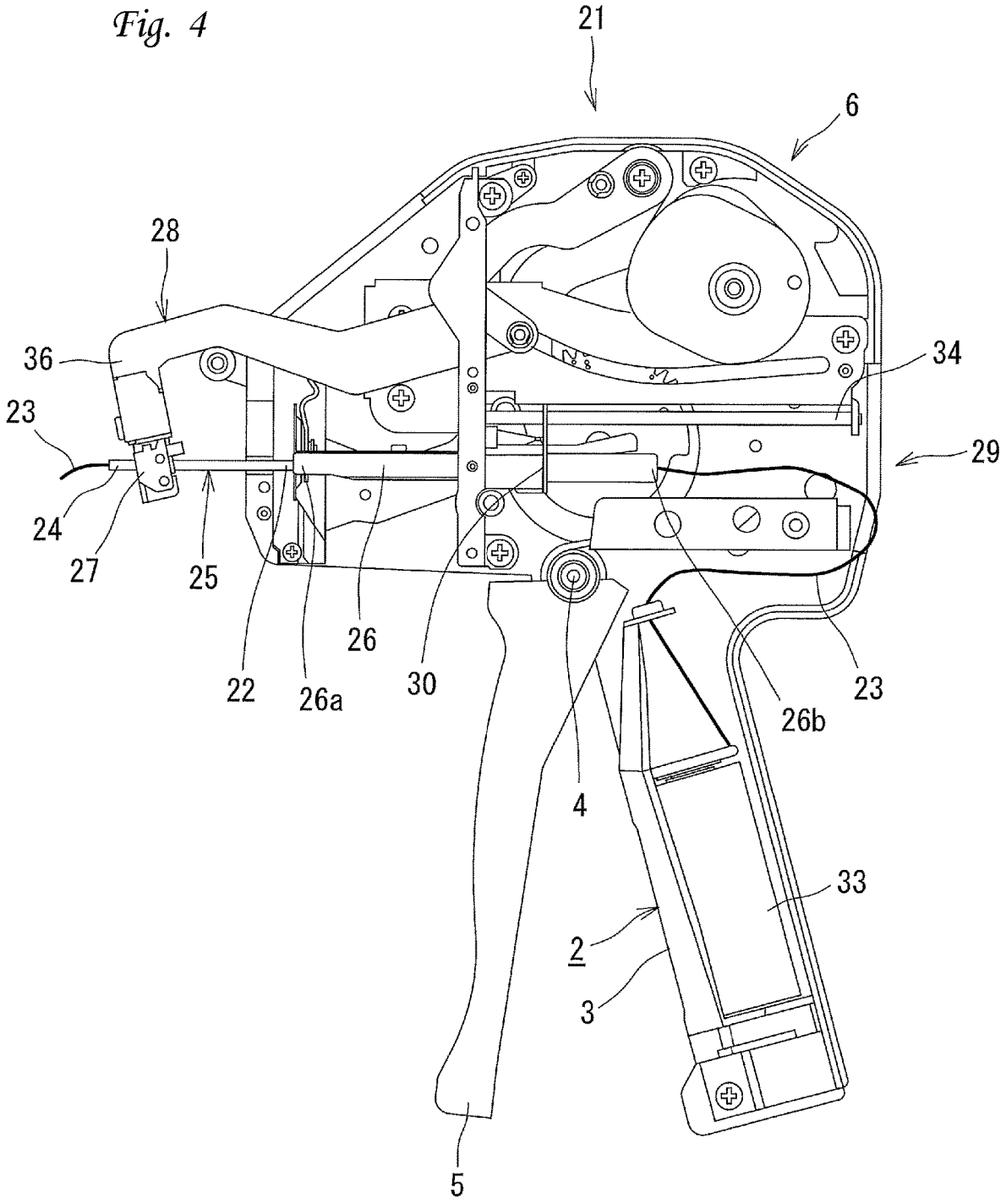

Grasping the driving lever 5 again to pivot it, for example, by 5.6 degrees, makes no movement of the pipe unit 25. The gripper unit 27 is moved alone, as shown in FIG. 4, to further advance and fall in turn. This causes it to abut the pipe unit 25. The pipe unit 25 is forced between the pair of gripper pieces 39 and 41, and thereby the pair of gripper pieces 39 and 41 are compulsorily opened.

Figure 5:
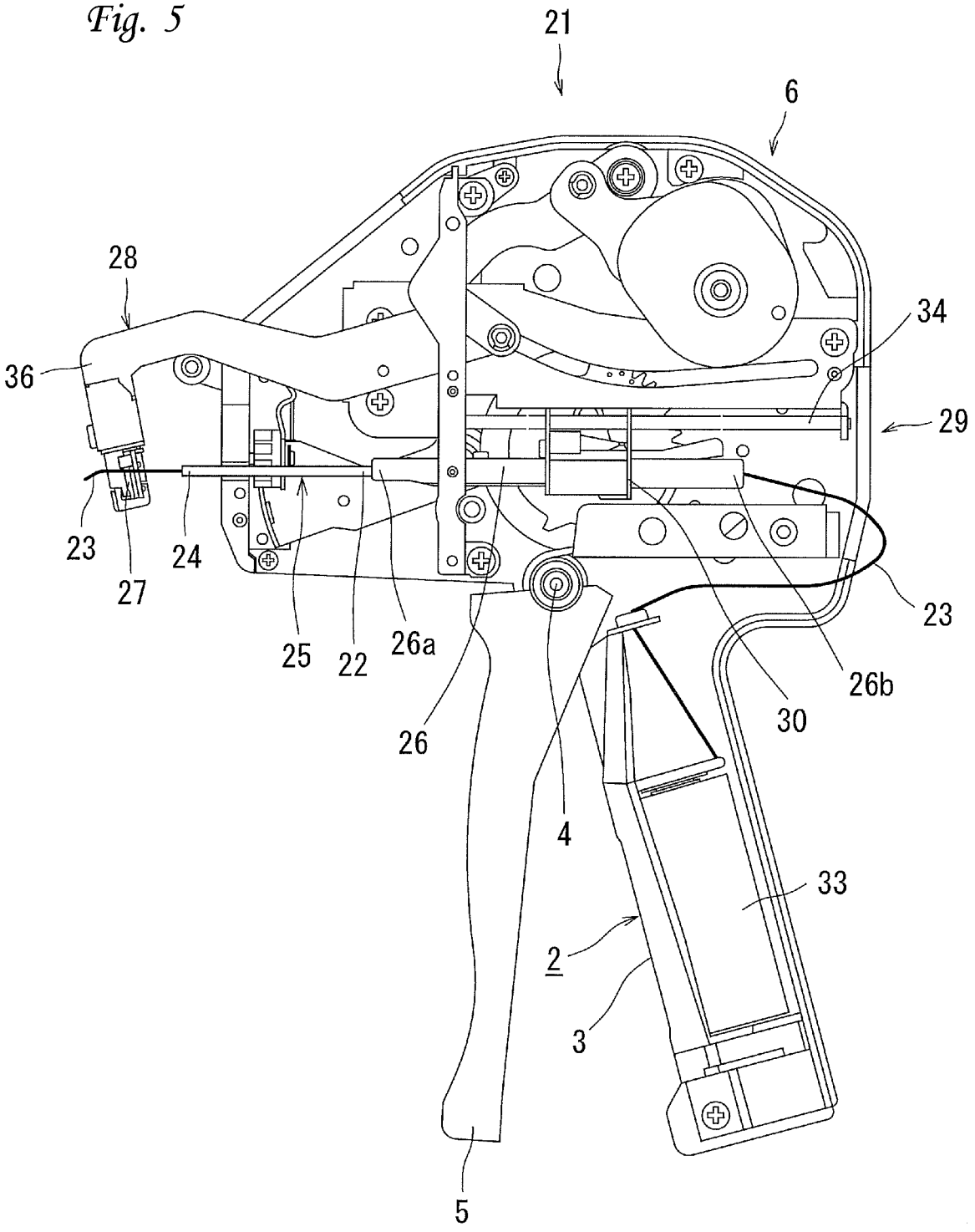

Further grasping the driving lever 5 to pivot it, for example, by 11.4 degrees in total, makes no movement of the gripper unit 27 in turn. The pipe unit 25 is moved alone, as shown in FIG. 5, to retreat and thereby to escape from the pair of gripper pieces 39 and 41. This permits the gripper pieces 39 and 41 to close, and thereby to grip the thread 23 exposed from the front side opening 24 of the pipe unit 25. Further retreat of the pipe unit 25 makes the thread 23 to be drawn from the pipe unit 25.

Figure 6:
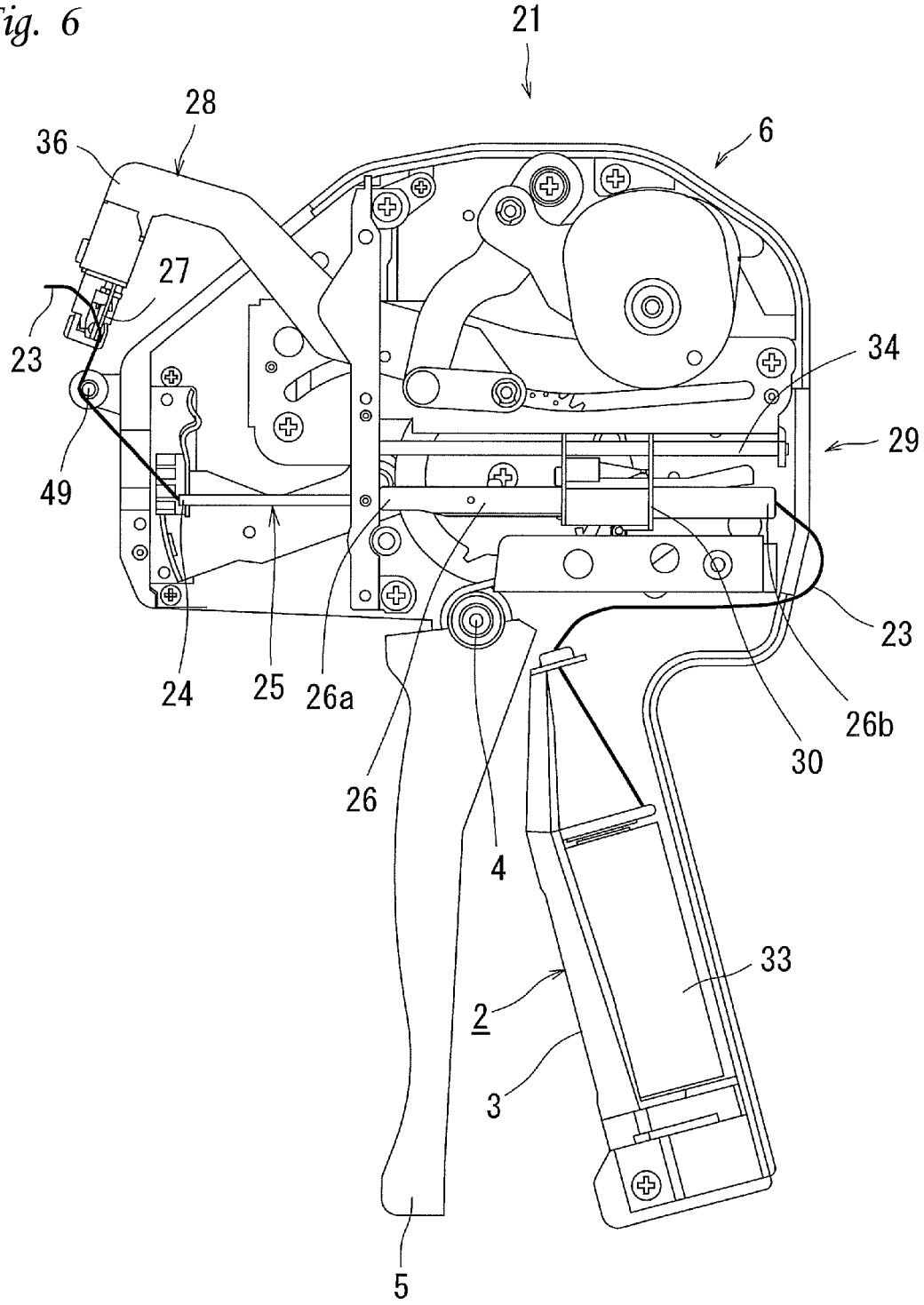

Further grasping the driving lever 5 to pivot it, for example, by 14 degrees in total, makes further retreat of the pipe unit 25, as shown in FIG. 6, to return into the machine frame 2. The gripper unit 27 rises to draw and lift up the gripped thread 23. This makes the thread 23 hung on the thread hanging unit 49.

Figure 7:
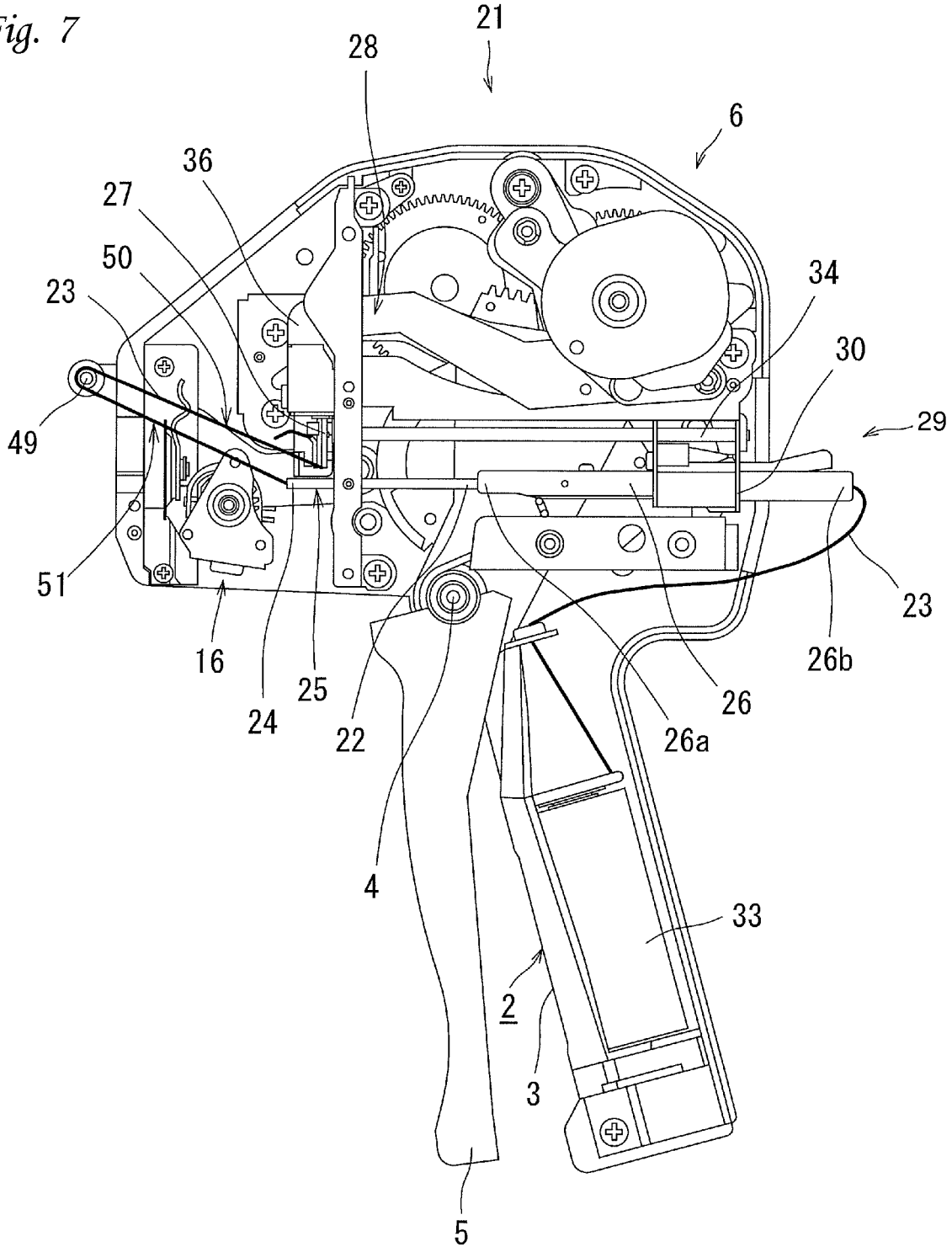

Further grasping the driving lever 5 to pivot it, for example, by 22.2 degrees in total, makes retreat of the pipe unit 25 to the very back, as shown in FIG. 7. This makes a midway portion 51 of the thread 23 between the front side opening 24 of the pipe unit 25 and the object to be exposed and located above the thread tying mechanism 16 in the machine frame 2. The gripper unit 27 retreats and fall to also move to the very back. This makes the thread 23 to be retracted, and an end portion 50 of the thread 23 between the thread hanging unit 49 and the gripper unit 27 to be also located above the thread tying mechanism 16 in the machine frame 2.

Figure 8:
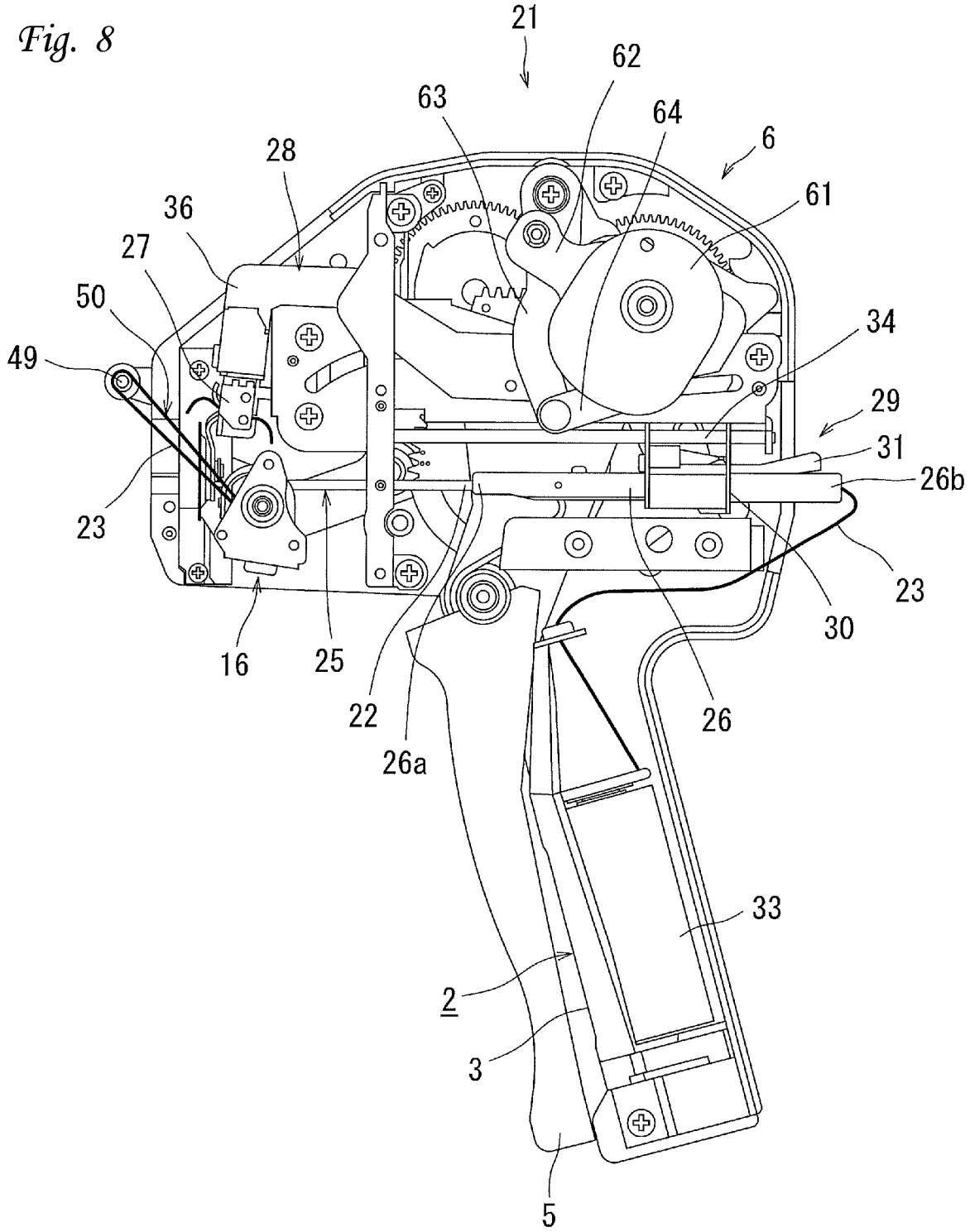

Further grasping the driving lever 5 to pivot it at most, for example, by 29.4 degrees in total, the pipe unit 25 and the gripper unit 27 advance a little, as shown in FIG. 8. This produces slacks for tying the thread 23. Utilizing it, the thread tying mechanism 16 ties the end portion 50 and the midway portion 51 of the thread 23, to form a loop penetrating the object. Then, the thread tying mechanism 16 cuts the thread 23 to separate the formed loop from the thread 23.

A tip of the cut thread 23 is exposed from the front side opening 24 of the pipe unit 25. This enables to continuously perform another tag mounting work.

As described above, the tag mounter 21 does not require to insert the thread through a needle eye. This enables to ease restriction of thicknesses and/or types of threads. Thus, various threads including a gold thread or a silver thread can be used.

Gripping the pipe unit 25 by the gripper unit 27 and escaping the pipe unit 25 from the gripper unit 27 enables the gripper unit 27 to grip the thread exposed from the tip of the pipe unit 25. This enables ensure to grip the thread.

Pushing the gripper pieces 39 and 41 by the pipe unit 25 forces the gripper pieces 39 and 41 to open and to grip it.

This eliminates requirement of a structure for opening the gripper pieces 39 and 41 provided in the gripper unit 27. This enables to simplize the structure of the gripper unit 27.

Retracting and hanging the thread 23 on the thread hanging unit 49 by the gripper unit 27 enables to uniformize a size of the formed loop.

The above described embodiments are examples to make it easier to understand the present invention. The present invention is not limited to the examples, and includes any modified, altered, added, or removed variations, without departing from the scope of the claims attached herewith. This can be easily understood by persons skilled in the art.

REFERENCE SIGNS LIST

1 and 21: tag mounter; 2: machine frame; 3: handle; 4: lever shaft; 5: driving lever; 6: driver unit; 7: needle eye; 8: piercing needle; 9: cylindrical needle; 10: engaging rod; 11: locking member; 12: threading hook; 13: hooking member; 14: thread grasping section; 15: thread grasping mechanism; 16: thread tying mechanism; 17: thread handling mechanism; 18 and 19: side plate; 20: front end plate; 22 and 26*b* rear side opening; 23 and T: thread; 24 and 26*a*: front side opening; 25: pipe unit; 26: pipe holding unit; 27: gripper unit; 28: gripper supporting unit; 29: movement mechanism; 30: frame unit; 31: release lever; 33: bobbin; 34: frame guiding shaft; 35: base portion; 35*a*: engagement protrusion; 36: winding portion; 37: shaft section; 38 and 40: biasing member; 39 and 41: gripper piece; 42: pinion; 43: knot forming unit; 44: rotary shaft; 45 and 47: beak; 46: shaft; 48: neck section; 49: thread hanging unit; 50: end portion; 51: midway portion; 61: cam; 62: connector unit; 63: linkage unit; 64: connector linkage unit; and, V: object.

The invention claimed is:

1. A tag mounter for mounting a tag to an object by passing and tying a thread through the object, the tag mounter comprising:

a pipe unit configured to have the thread inserted therethrough;

a movement mechanism configured to move the pipe unit toward a front direction and a rear direction;

a gripper unit configured to grip the thread inserted through the pipe unit and exposed from a tip of the pipe unit;

a driver mechanism configured to move the gripper unit along a predetermined course; and a thread tying mechanism configured to tie the thread gripped by the gripper unit, wherein the gripper unit is configured to grip the tip of the pipe unit when the movement mechanism moves the pipe unit toward the front direction, and the movement mechanism is configured to move the pipe unit toward the rear direction with the gripper unit gripping the tip of the pipe unit, so that the pipe unit escapes from the gripper unit and the gripper unit grips the thread exposed from the tip of the pipe unit.

2. A tag mounter for mounting a tag to an object by passing and tying a thread through the object, the tag mounter comprising:

a pipe unit configured to have the thread inserted therethrough;

a movement mechanism configured to move the pipe unit toward a front direction and a rear direction;

a gripper unit configured to grip the thread inserted through the pipe unit and exposed from a tip of the pipe unit;

a driver mechanism configured to move the gripper unit along a predetermined course; and a thread tying mechanism configured to tie the thread gripped by the gripper unit, wherein the gripper unit has a pair of gripper pieces capable of opening and closing, and biased toward a closing direction, and the thread is gripped between the pair of gripper pieces.

3. The tag mounter of claim 1, wherein the gripper unit has a pair of gripper pieces capable of opening and closing, and biased toward a closing direction, and the thread is gripped between the pair of gripper pieces.

4. The tag mounter of claim 2, wherein the pair of gripper pieces are arranged to close in a front side.

5. The tag mounter of claim 2, wherein the movement of the gripper unit caused by the driver mechanism causes the pipe unit to abut the pair of gripper pieces and to force the pair of gripper pieces to open.

6. The tag mounter of claim 4, wherein the movement of the gripper unit caused by the driver mechanism causes the pipe unit to abut the pair of gripper pieces and to force the pair of gripper pieces to open.

7. The tag mounter of claim 1, wherein the movement of the pipe unit in the front direction caused by the movement mechanism causes the pipe unit to penetrate the object, and the movement of the pipe unit in the rear direction caused by the movement mechanism causes the pipe unit to escape from the object, so that the thread gripped by the gripper unit remains alone penetrating the object.

8. The tag mounter of claim 2, wherein the movement of the pipe unit in the front direction caused by the movement mechanism causes the pipe unit to penetrate the object, and the movement of the pipe unit in the rear direction caused by the movement mechanism causes the pipe unit to escape from the object, so that the thread gripped by the gripper unit remains alone penetrating the object.

9. The tag mounter of claim 7, wherein the driver mechanism is configured to move the gripper unit to a far side of the object by taking a detour above the object, to grip the tip of the pipe unit penetrating the object and exposed from a back face of the object, the driver mechanism is configured to move the gripper unit to a near side of the object by taking a detour above the object, after the pipe unit moves toward the rear direction and the gripper unit grips the thread, and the thread tying mechanism is located at the near side of the object, and configured to tie the thread gripped by the gripper unit and the thread before the object.

10. The tag mounter of claim 8, wherein the driver mechanism is configured to move the gripper unit to a far side of the object by taking a detour above the object, to grip the tip of the pipe unit penetrating the object and exposed from a back face of the object, the driver mechanism is configured to move the gripper unit to a near side of the object by taking a detour above the object, after the pipe unit moves toward the rear direction and the gripper unit grips the thread, and the thread tying mechanism is located at the near side of the object, and configured to tie the thread gripped by the gripper unit and the thread before the object.

11. A tag mounter for mounting a tag to an object by passing and tying a thread through the object, the tag mounter comprising:

a pipe unit configured to have the thread inserted therethrough;

a movement mechanism configured to move the pipe unit toward a front direction and a rear direction;

a gripper unit configured to grip the thread inserted through the pipe unit and exposed from a tip of the pipe unit;

a driver mechanism configured to move the gripper unit along a predetermined course;

a thread tying mechanism configured to tie the thread gripped by the gripper unit; and a thread hanging unit disposed above the pipe unit, wherein the movement of the pipe unit in the front direction caused by the movement mechanism causes the pipe unit to penetrate the object, the movement of the pipe unit in the rear direction caused by the movement mechanism causes the pipe unit to escape from the object, so that the thread gripped by the gripper unit remains alone penetrating the object, the driver mechanism is configured to move the gripper unit to a far side of the object by taking a detour above the object, to grip the tip of the pipe unit penetrating the object and exposed from a back face of the object, the driver mechanism is configured to move the gripper unit to a near side of the object by taking a detour above the object, after the pipe unit moves toward the rear direction and the gripper unit grips the thread, the thread tying mechanism is located at the near side of the object, and configured to tie the thread gripped by the gripper unit and the thread before the object, and the thread gripped by the gripper unit is hung on the thread hanging unit to form a loop, when the gripper unit moves to the near side of the object by taking a detour above the object.

12. The tag mounter of claim 10, further comprising a thread hanging unit disposed above the pipe unit, wherein the thread gripped by the gripper unit is hung on the thread hanging unit to form a loop, when the gripper unit moves to the near side of the object by taking a detour above the object.

* * * * *